US008137187B2

(12) United States Patent
Walker et al.

(10) Patent No.: US 8,137,187 B2
(45) Date of Patent: Mar. 20, 2012

(54) SYSTEMS AND METHODS FOR REDEEMING FUTURE VALUE WAGERING CHIPS

(75) Inventors: Jay S. Walker, Ridgefield, CT (US); James A. Jorasch, Stamford, CT (US)

(73) Assignee: IGT, Reno, NV (US)

( * ) Notice: Subject to any disclaimer, the term of this patent is extended or adjusted under 35 U.S.C. 154(b) by 690 days.

(21) Appl. No.: 11/435,118

(22) Filed: May 16, 2006

(65) Prior Publication Data

US 2006/0205486 A1 Sep. 14, 2006

Related U.S. Application Data

(60) Division of application No. 09/460,353, filed on Feb. 28, 2000, now abandoned, which is a continuation of application No. 08/892,080, filed on Jul. 14, 1997, now Pat. No. 6,110,042.

(51) Int. Cl.
*A63F 9/24* (2006.01)

(52) U.S. Cl. ..... 463/25

(58) Field of Classification Search ..... 463/25
See application file for complete search history.

(56) References Cited

U.S. PATENT DOCUMENTS

| | | | | |
|---|---|---|---|---|
| 4,275,810 | A | 6/1981 | Waldmeier | |
| 4,319,336 | A | 3/1982 | Anderson et al. | 705/21 |
| 4,486,849 | A | 12/1984 | Harigaya et al. | |
| 4,507,745 | A | 3/1985 | Agrawal | |
| 4,575,622 | A | 3/1986 | Pellegrini | 463/25 |
| 4,739,478 | A | 4/1988 | Roberts et al. | |
| 4,815,741 | A * | 3/1989 | Small | 463/17 |
| 4,856,788 | A | 8/1989 | Fischel | 275/256 |
| 4,997,188 | A | 3/1991 | Nilssen | 705/14 |
| 5,003,473 | A | 3/1991 | Richards | |
| 5,083,782 | A | 1/1992 | Nilssen | 705/35 |
| 5,083,784 | A | 1/1992 | Nilssen | 705/14 |
| 5,166,502 | A | 11/1992 | Rendleman et al. | 235/492 |
| 5,195,031 | A | 3/1993 | Ordish | |
| 5,237,500 | A | 8/1993 | Perg et al. | |
| 5,252,811 | A | 10/1993 | Henochowicz et al. | |
| 5,257,179 | A | 10/1993 | DeMar | 463/25 |
| 5,283,422 | A | 2/1994 | Storch et al. | 235/375 |
| 5,326,104 | A | 7/1994 | Pease et al. | 463/18 |
| 5,361,885 | A | 11/1994 | Molder | 194/214 |
| 5,397,125 | A | 3/1995 | Adams | |
| 5,516,104 | A | 5/1996 | Takemoto et al. | 463/26 |
| 5,603,659 | A | 2/1997 | Okada | 463/25 |
| 5,620,182 | A | 4/1997 | Rossides | |
| 5,676,376 | A | 10/1997 | Valley | 273/288 |
| 5,766,075 | A | 6/1998 | Cook et al. | |
| 5,873,782 | A | 2/1999 | Hall | |
| 5,895,321 | A | 4/1999 | Gassies et al. | |
| 6,017,063 | A | 1/2000 | Nilssen | 283/67 |

(Continued)

OTHER PUBLICATIONS

Merriam Webster's New Collegiate Dictionary, 1997, Merriam Webster Incorporated, 10th Edition, p. 1106.*

(Continued)

*Primary Examiner* — Corbett B Coburn
(74) *Attorney, Agent, or Firm* — K&L Gates LLP

(57) ABSTRACT

A system and method enabling a casino to issue chips or credits to customers whose redemption and face value is set at some future date, as well as systems and methods for facilitating redemption of such future value wagering chips.

13 Claims, 12 Drawing Sheets

U.S. PATENT DOCUMENTS

| | | | | |
|---|---|---|---|---|
| 6,056,289 | A | 5/2000 | Clapper, Jr. | 273/138.2 |
| 7,110,981 | B1 * | 9/2006 | Sidikman et al. | 705/43 |

OTHER PUBLICATIONS

Nevada State Gaming Commission Regulations, Section 29.020, Dated Jul. 1980.*
Office Action for U.S. Appl. No. 09/460,353, dated Feb. 4, 2004, 5pp.
Office Action for U.S. Appl. No. 09/460,353, dated Jun. 7, 2004, 9pp.
Office Action for U.S. Appl. No. 09/460,353, dated Dec. 5, 2005, 17pp.
Office Action for U.S. Appl. No. 09/460,353, dated Dec. 13, 2005, 17 pp.
Advisory Action for U.S. Appl. No. 09/460,353, dated Mar. 29, 2006, 6pp.
Office Action for U.S. Appl. No. 09/460,353, dated May 3, 2007, 13 pp.
Securities Act of 1933 (not provided).
Securities Exchange Act of 1934 (not provided).
Scarne, *Scarne's New Complete Guide to Gambling*, 1961, Simon & Schuster, pp. 248-252.
Kilby et al., *Casino Operations Management*, 1998, John Wiley & Sons, Inc., pp. 79-80.
Napach, Bernice "Zero-coupon Munis Priced Lure Investors", Investor's Business Daily, New York; May 12, 1993; Section: Investor's Corner, p. 1.
Bruce, Rupert "Zero-coupon Bonds: An American Export That's Catching on", International Herald Tribune (Neuilly-sur-Seine, France), Oct. 21, 1995; Section: Money Report.
Scheibal, Steve "Lotto player's choice: money now or later", The Austin American-Statesman, Feb. 10, 1997; Section: News; p. A1.
"Zero-coupon bonds: Zero-coupon bonds: sell at a discount", Sun-Sentinel (Fort Lauderdale, FL); Feb. 24, 1997; Section: Business, p. 22.
Notice of Allowability for U.S. Appl. No. 08/892,080 dated Sep. 30, 1999, 1pg.
Interview Summary for U.S. Appl. No. 09/460,353 dated Sep. 17, 2007, 2pp.
Office Action for U.S. Appl. No. 09/460,353 dated Feb. 7, 2008, 12pp.

* cited by examiner

260

| | PRESENT DATE 301 | FEBRUARY 2007 302 | MAY 2017 303 | FEBRUARY 2027 304 |
|---|---|---|---|---|
| 310 | 05/01/97 | 6.70% | 7.02% | 6.94% |
| 311 | 05/02/97 | 6.70% | 7.03% | 6.94% |
| 312 | 05/05/97 | 6.68% | 7.00% | 6.91% |

FIG. 3

270

| | BOND ID NUMBER 401 | CUSTOMER ID NUMBER 402 | CUSTOMER NAME 403 | DATE ISSUED 404 | MATURITY DATE 405 | FACE VALUE 406 | PRESENT VALUE 407 |
|---|---|---|---|---|---|---|---|
| 410 | 36754555 | 456456 | JOHN GREEN | 8/26/97 | JAN. 1, 2050 | $10,000.00 | $277.11 |
| 411 | 36754556 | 987267 | MIKE SIMMS | 8/26/97 | JAN. 1, 2050 | $15,250.00 | $422.60 |
| 412 | 36754557 | 564926 | SUSAN ANDERSON | 8/26/97 | JAN. 1, 2040 | $60,100.00 | $3,276.21 |

FIG. 4

SYSTEMS AND METHODS FOR REDEEMING FUTURE VALUE WAGERING CHIPS

CROSS REFERENCE TO RELATED APPLICATIONS

The present application is a divisional application of U.S. patent application Ser. No. 09/460,353 filed Feb. 28, 2000 now abandoned, which is a continuation of U.S. patent application Ser. No. 08/892,080 filed Jul. 14, 1997, which issued as U.S. Pat. No. 6,110,042.

BACKGROUND OF THE INVENTION

1. Field of the Invention

This invention relates to a system and method for enabling wagering in casino games using the future value of money.

2. Description of the Related Art

Many gamblers like the idea or experience of gambling with large amounts of money. They want to feel and act like a "high roller." Most gamblers, however, do not have the financial resources to bet at this level. Even those gamblers with sufficient funds available are often reluctant to place that much money at risk. The typical gambler is thus restricted in that he may only wager the amount of money that he is comfortable putting at risk, diminishing his playing experience.

Casinos have tried to solve this problem, and thereby enhance the experience of winning, by magnifying the perceived payouts of slot machine jackpots. This magnification is typically accomplished by electronically displaying the enhanced jackpot value at or near the slot machine, with winnings paid in equal installments over a large number of years, often twenty or more. A $1,000,000 jackpot, for example, might be paid as 25 annual installments of $40,000. By extending payouts over a number of years, rather than paying as a lump sum, casinos are able to support substantially higher "total" payouts while holding operating margins to acceptable levels. For example, the net present value of a 25 year payout stream is usually less than 50% of its cumulative value of payments. Thus, the $1,000,000 slot machine jackpot paid out over 25 years may be purchased by the casino for $300,000 to $400,000, depending on the prevailing interest rates at the time of purchase.

Due to the natural tendency of people to underestimate the net present discounted value of money, the gambler often perceives the $1,000,000 annuity payout to be substantially superior to a $300,000 to $400,000 lump sum payout. This extended payment technique is also used by state lotteries for their top lotto jackpots. The lottery sponsor can thus advertise a larger annuity prize than what is being paid out in a net present value sense, enhancing the perceived value of the payout.

Paying out prizes as an annuity stream, however, is only practical for large and infrequent payouts since there is considerable operational overhead associated with purchasing the annuity and setting up the payment mechanism. Accomplishing such objectives requires not only human resources, but also computer accounting systems to maintain the annuity payment data. Such systems are totally impractical for prizes of less than several hundred thousand dollars, eliminating applicability to casino games such as blackjack or craps. Additionally, annuity payment systems magnify only the payout. The wager itself remains a lump sum. Consequently, gamblers lack the experience of being a "high roller" when buying a $1 lottery ticket or pulling the handle on a dollar slot machine.

As is apparent from the above-described deficiencies of conventional gambling payment systems, a need exists for a system which magnifies the perceived value of smaller payouts. A further need exists for a system which magnifies the perceived value of smaller wagers.

SUMMARY OF THE INVENTION

Generally, according to one aspect of the present invention, a method for disbursing future value gaming tokens is disclosed. The method includes the steps of receiving current value data representing a current financial value, receiving maturity data representing a maturity date and retrieving discount rate data representing a discount rate. The method further includes the step of determining a future financial value based on the current value data, maturity data and discount rate data. In one preferred embodiment, the step of determining a future final value is based on the equation $FV=PV\ (1+r)^n$. In an alternative embodiment, an exchange ratio may be used in place of an equation. The method also includes the step of disbursing future value gaming tokens representing the determined future financial value. A system is also provided for performing the steps of the above described method.

According to a second aspect of the present invention, a method is disclosed for redeeming a future value gaming token. The method includes the step of receiving future value data representing a value of a future value gaming token and redemption data representing a redemption date. The method also includes the step of retrieving maturity data representing a maturity date and discount rate data representing a discount rate. The method further includes the step of determining a redemption value of the future value gaming token at the redemption date based on the future value data, the discount rate data, the maturity data and the redemption data. In the preferred embodiment, the step of determining the present final value is based on the equation $PV=FV/(1+r)^n$. The method also includes the step of disbursing financial credit representing the redemption value. A system is also provided for performing the steps of the method for redeeming a future value gaming token.

A more complete understanding of the present invention, as well as further features and advantages of the present invention, will be apparent with reference to the following detailed description and drawings.

BRIEF DESCRIPTION OF THE DRAWINGS

FIG. 3 illustrates a sample table from the discount rate database of FIG. 2;

FIG. 4 illustrates a sample table from the bond database of FIG. 2;

DETAILED DESCRIPTION OF THE PREFERRED EMBODIMENTS

The present invention solves the above mentioned problems by providing a system and method for establishing a class of "future value" casino wagering chips, and for converting between these chips and conventional "present value" chips in a casino gaming environment. These future value chips differ from conventional chips in that they have an associated maturity date at which the player may cash them in for their face value. Prior to that date, they are redeemable for only a calculable fraction of their face value. Because the present value of future payments decreases rapidly as the maturity date grows, future values represent a large multiple of current value.

In a typical casino, chips issued by the casino are freely exchangeable within the casino for the cash value printed on its face. Most casinos offer a number of chip denominations, with different colors representing the different denominations. A typical color scheme includes black hundred dollar chips, green twenty-five dollar chips, red five dollar chips, and blue one dollar chips. Casinos normally use U.S. coins for fractional dollar amounts. Although most casino chips are round, some casinos favor square plaques, especially for higher denominations.

The future value chips of the present invention are similar to zero coupon bonds in that they pay their face value at maturity. In accordance with the invention, a gambler purchases future value chips for an amount less than the face value of the chips, much like purchasing a zero coupon bond at a discount to face value. For example, a future value chip worth $100 twenty years from its issue date might be purchased today for immediate use at $25. The present invention teaches the use of future value equations to perform appropriate calculations. In accordance with a preferred embodiment of the invention, bets placed with future value chips are paid with future value chips, although other payout schemes are possible, as described herein below.

A number of options are provided for converting accumulated future value chips. They may be held until maturity, exchanged for a bond that matures on the future value date, exchanged for current value chips, or cashed out for their present value.

Figure 1:
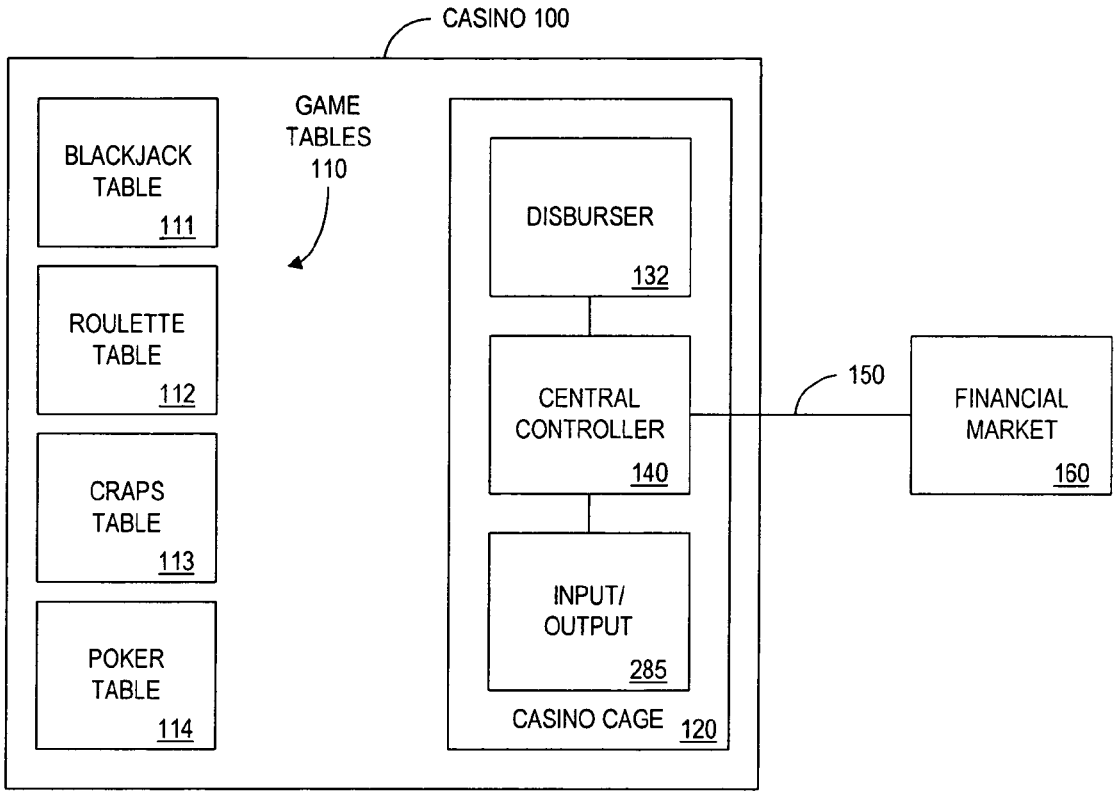
FIG. 1 is a schematic block diagram illustrating the system of the present invention.

Reference is now made to FIG. 1 which shows a casino 100 including game tables 110 and a casino cage 120. Game tables 110 include various games such as a blackjack table 111, a roulette table 112, a craps table 113, and a poker table 114. These games are shown for illustrative purposes and do not represent a comprehensive list of casino games.

Casino cage 120 is a conventional casino facility where players (gamblers) can purchase and redeem chips. Located within casino cage 120 is central controller 140, disburser 132, and input/output device 285. The communication links between central controller 140 and disburser 132 preferably comprise cable or wireless links on which electronic signals can propagate. Although disburser 132 and central controller 140 are shown in FIG. 1 located within casino cage 120, they may also be located outside casino cage 120, for example, near a gaming table such as poker table 114 so that players have easy access to the chip exchange process. Central controller 140 is in turn connected to financial market 160. Input/output device (I/O device) 285 is a conventional I/O device such as a touch screen or keypad and display, operable by a cashier employee working within cage 120, and is typically used to perform routine transactions similar to a bank teller.

Figure 2:
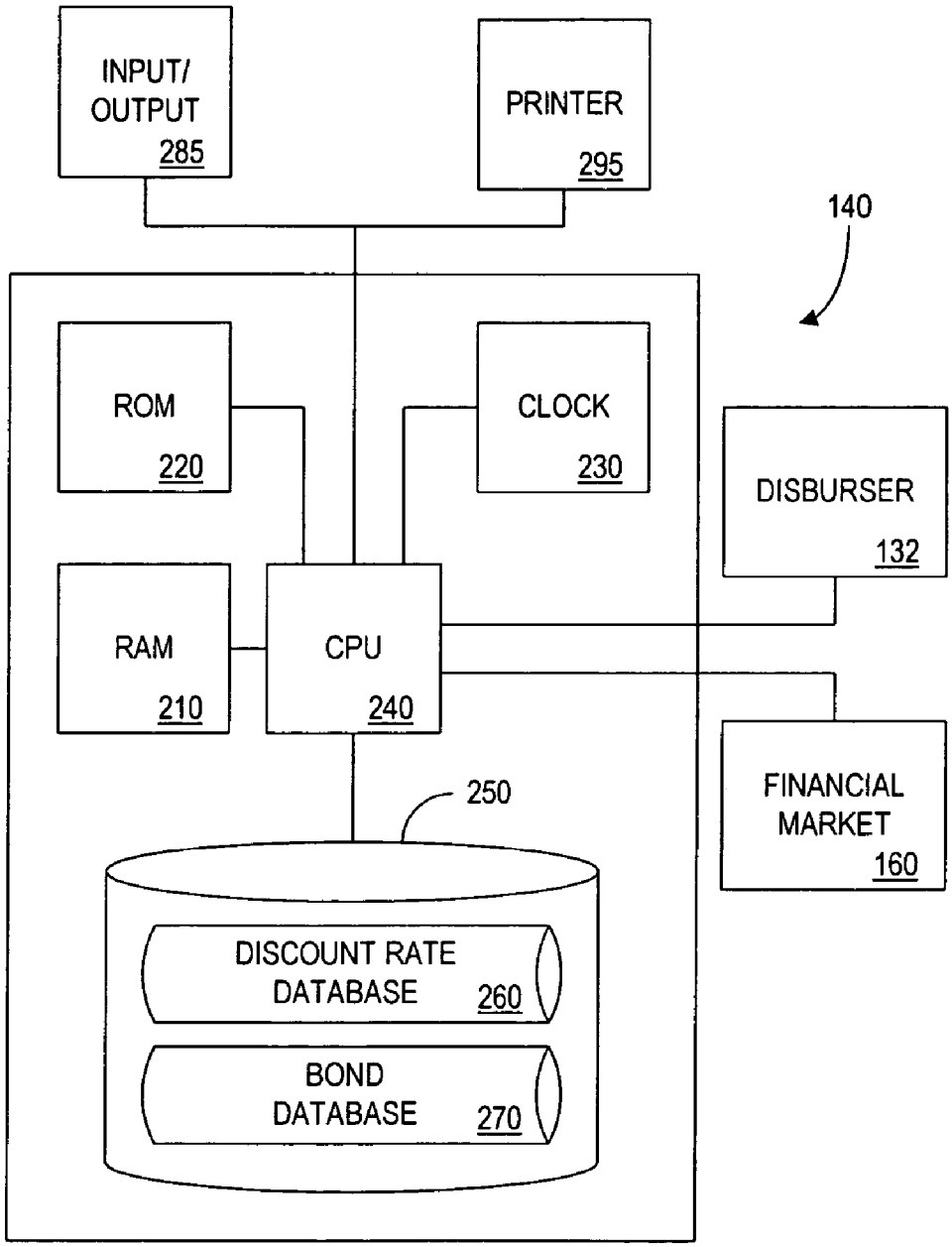
FIG. 2 is a schematic block diagram of the central controller of FIG. 1.

FIG. 2 is a block diagram showing the architecture of an illustrative central controller 140. The central controller 140 may be embodied, for example, as a conventional personal computer, manufactured by IBM Corp., as modified herein to execute the functions and operations of the present invention. The central controller 140 is a computer system which preferably includes standard interconnected hardware components, such as random access memory 210 (RAM 210), read only memory 220 (ROM 220), clock 230, CPU 240 and data storage device 250. CPU 240 is also connected to I/O device 285 and printer 295. CPU 240 executes program instructions which are typically stored in RAM 210, ROM 220 and/or data storage device 250. Data storage device 250 may be comprised of a single disk or disk array, and may be local to CPU 240, or may be distributed across a network. As shown in FIG. 2, the data storage device 250 includes a discount rate database 260 and bond database 270. The discount rate database preferably stores the financial information used to support the discount rate used in the future value equation described in detail below. The bond database preferably stores electronic records of each bond certificate issued to customers in exchange for future value chips. CPU 240 communicates with financial market 160 over the Internet or other suitable online network. Financial market 160 represents any appropriate source for the necessary financial data described below.

Central controller 140 stores the future value equation, either in data storage device 250 or ROM 220. This equation takes as an input the present value, discount rate, and number of years to maturity. It returns the future value. The present value is the current value of the chip or bond. The equation is symbolically represented as follows:

$$FV=PV*(1+r)^n$$

where FV is the future value

PV is the present value r is the discount rate on an annual basis n is the time to maturity in years For clarity of illustration, the discount rate and time to maturity in the above equation are expressed in years. Those of ordinary skill in the art will appreciate that more precise inputs could be used, such as expressing the discount rate and time to maturity on a per day basis. The practice of using financial equations to calculate future value or present value is well known in the art and need not be described here in detail. For reference, one of ordinary skill in the art may refer to Richard A. Brealey and Stewart C. Myers, Principles of Corporate Finance, (Fourth Ed, McGraw-Hill, Inc., 1991).

Discount rate database 260 contains representative financial data used to determine the discount rate used in future value and present value calculations. The information is updated periodically by CPU 240 via the online connection from financial market 160. In FIG. 3 an exemplary database is shown for discount rate database 260. In particular, this database contains fields, shown as fields 301, 302, 303, 304 for the current date and prevailing interest rate yields of several U.S. Treasury bonds of various maturity dates. Each record contains data for a given day, as illustrated by records 310, 311, and 312. Field 301 represents the date on which the interest rate data was obtained, field 302 is the yield of treasury bonds with a maturity date of February 2007, field 303 is the yield of treasury bonds with a maturity date of May 2017, and field 304 is the yield of treasury bonds with a maturity date of February 2027. These interest rates represent a near risk-free rate of return and thus serve as an excellent reference point in estimating a discount rate. These interest rates are available in the business section of most newspapers, and are available in real time via financial networks. For example, Bloomberg terminals, also available from Bloomberg L. P., offer a broad range of interest rate data.

Referring now to the illustrative data of discount rate database 260, record 311 illustrates the treasury bond rates for May 2, 1997. The yield of treasury bonds maturing in February of 2007 was 6.70%, the yield of treasury bonds maturing in May of 2017 was 7.03%, while the yield of treasury bonds maturing in February of 2027 was 6.94%. It should be understood that there are many sources of discount rate data, including corporate bond rates, bank lending rates, etc. The use of treasury bond interest rates is especially convenient due to the ease of retrieving current values, the relatively long maturities represented, and the conservative results obtained with their use (i.e. use of lower discount rates leads to lower calculated future value, all else held equal). The discount rate may also reflect the weighted average cost of capital (WACC) of the casino issuing the future value chips. In this respect, outside financial data is not required to compute the discount rate, except to the extent that market factors (such as corporate borrowing rates) influence the WACC.

Because interest rates typically change very little on a day to day basis, and because the interest rate of treasury bonds of any maturity is less than the discount rate applied to cash flows of any company, casinos could update discount rate database 260 less frequently than once per day. Additionally, casinos could use the interest rate for one maturity date of treasury bonds, using this interest rate as the discount rate used in the future value equation. Those of ordinary skill in the art will appreciate that the future value equation may be greatly simplified by calculating exchange data representing a future value exchange ratio. Such an exchange ratio incorporates a maturity date and discount rate into one number, acting like a "multiplier" that may be applied to the present value to obtain a future value. The multiplier for a discount rate of 7.0% and a time to maturity of thirty years is 7.6122 since $$(1.07)^{30}=7.6122$$

Casinos could prepare multipliers for each maturity date offered, updating the multiplier only when market interest rate changes force an update of the discount rate used to determine the multiplier. These multipliers could be stored in data storage device 250, or made available to cashiers in printed form.

FIG. 4 illustrates an exemplary bond database 270. It tracks all bonds issued to customers in exchange for future value chips. As used herein, the term bond describes a negotiable instrument provided to the player. A new record is generated every time a bond is issued, as represented by illustrative records 410, 411, and 412. In particular, this database contains fields, shown as bond ID number 401, customer ID number 402, customer name 403, date issued 404, maturity date 405, face value 406, and present value 407. As an example, record 410 illustrates that bond ID number 36754555 for customer ID number 456456 (John Green) has a bond issued Aug. 26, 1997 whose present value is $277.11 and is redeemable for $10,000 in January of 2050.

Figure 5A:
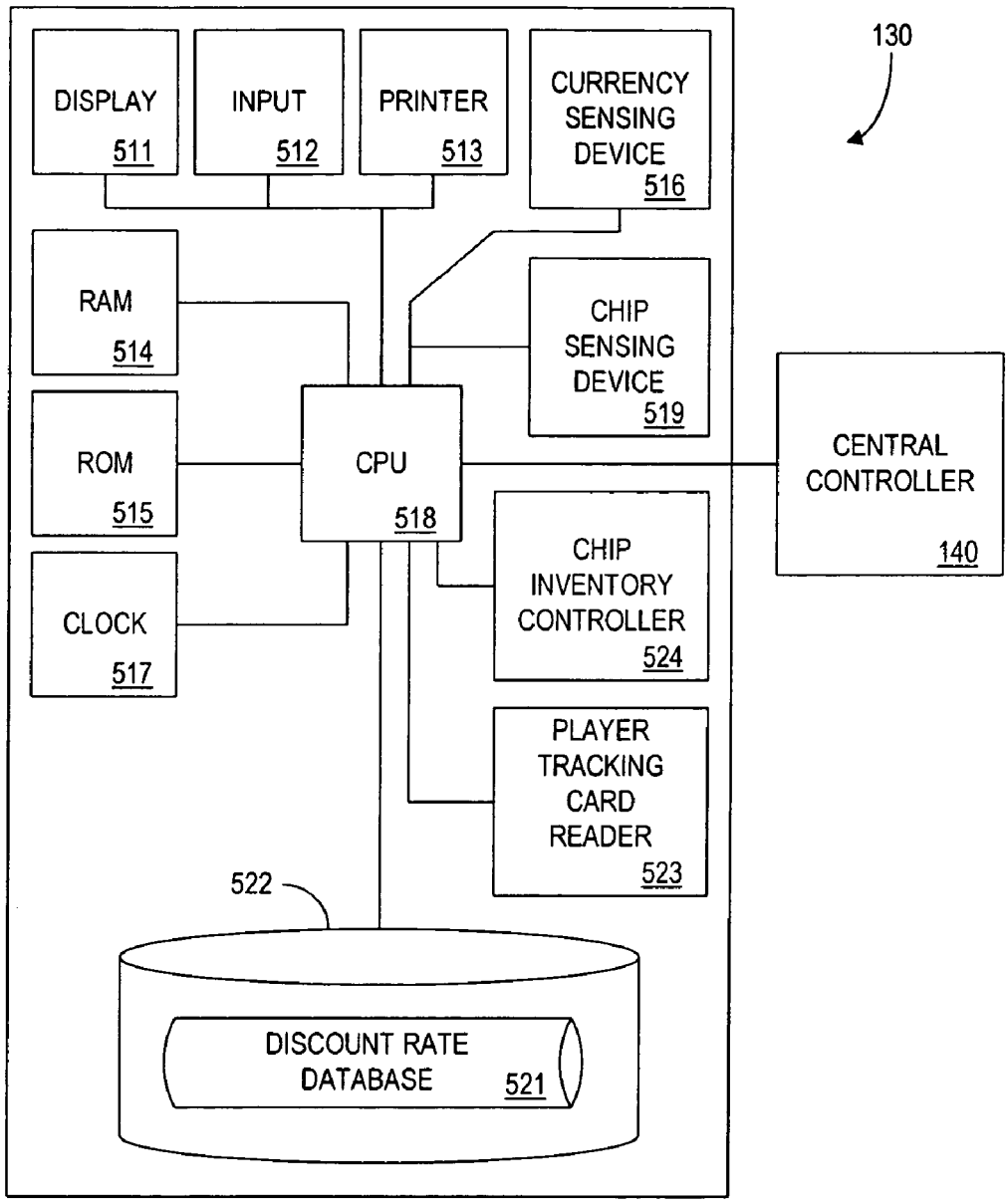
FIG. 5*a* is a schematic block diagram of an alternate embodiment of the disburser of FIG. 2.

FIG. 5*a* is a block diagram showing the architecture of an illustrative chip disburser 130. The embodiment of chip disburser 130 described here duplicates much of the functionality also provided by central controller 140 described in FIG. 2, allowing stand alone operation of the disburser. This embodiment of chip disburser 130 preferably includes standard hardware components, such as random access memory 514 (RAM 514), read only memory 515 (ROM 515), clock 517, CPU 518 and data storage device 522. CPU 518 is also connected to display 511, input device 512, and printer 513. CPU 518 executes program instructions which are typically stored in RAM 514, ROM 515 and/or data storage device 522. Data storage device 522 may be comprised of a single disk or disk array, and may be local to CPU 518, or may be distributed across a network. As shown in FIG. 5*a*, the data storage device 522 includes a discount rate database 521 which preferably stores the financial information used to support the discount rate as described in FIG. 3. Additionally, a currency sensing device 516 is included which is capable of accepting and sorting paper currencies, allowing a player to exchange paper currency for future value chips. Chips sensing device 519 performs a similar function for current value or future value chips deposited, and may use conventional coin sensing technology found in vending machines and slot machines. A chip inventory controller 523 receives signals from CPU 518 indicating the number and denomination of chips to be disbursed into the payout tray (not shown). Player tracking card reader 524 is configured to read conventional casino player tracking cards, allowing a player to provide identification by swiping his card through the reader. Player identification information is required for those embodiments in which chip disburser printer 513 dispenses bond certificates to players. Alternatively, input 512 may be configured with a numeric keypad into which players may type in their identification number directly.

Figure 5B:
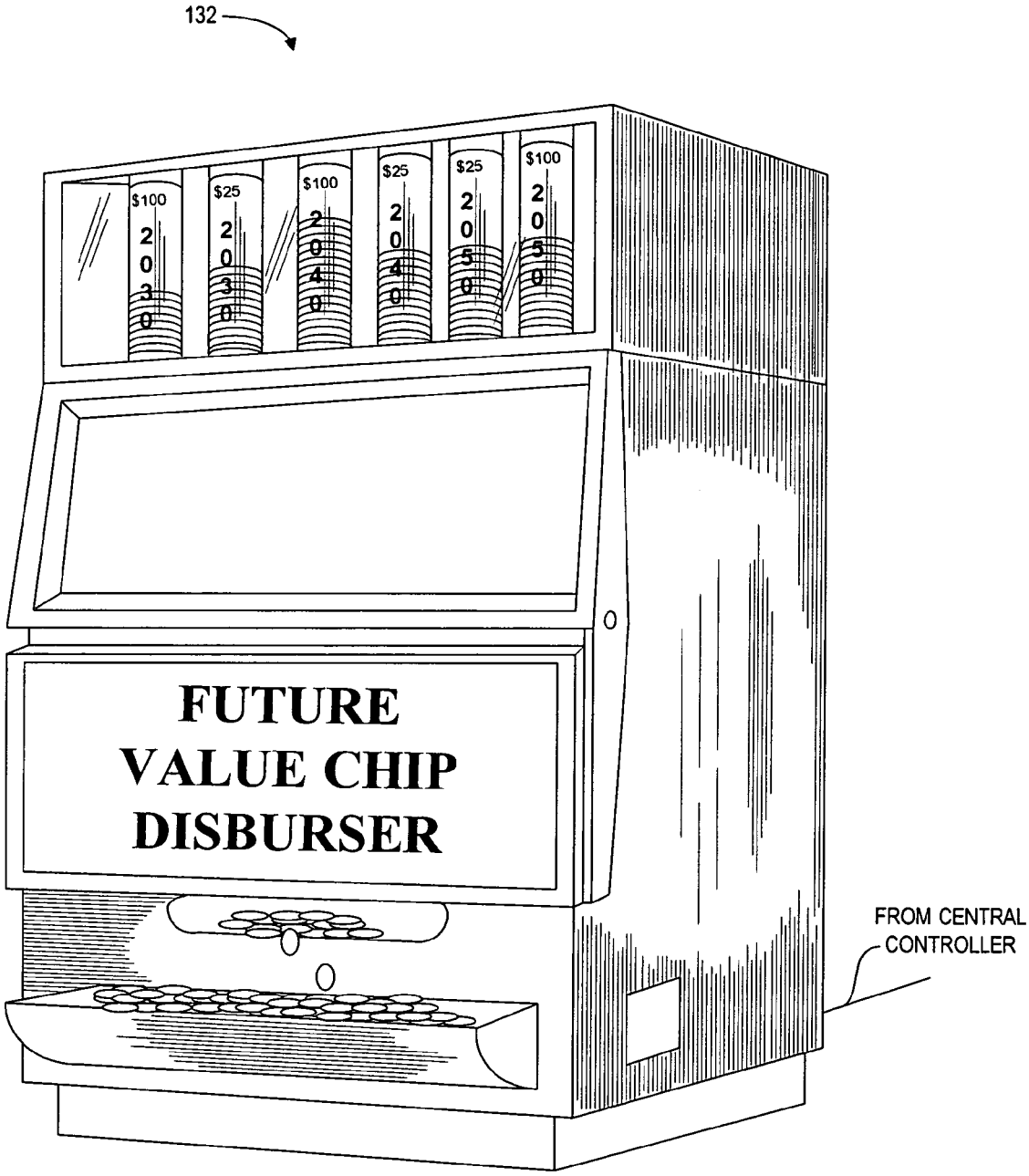
FIG. 5*b* shows a plan view of an illustrative disburser of FIG. 2.

FIG. 5*b* shows a plan view of another embodiment of a chip disburser 132 for which central controller 140 calculates the amount of future value chips to be disbursed. In such an embodiment, chip disburser 132 requires only limited memory and processing power, since it functions only to dispense chips. Currency dispensing mechanisms are well known to those of ordinary skill in the art and hence are not discussed herein. Disburser 132 receives a signal from CPU 240 of central controller 140, indicating the quantity and denomination of future value chips to disburse from the chip inventory stored therein. Chip disburser 132 is preferably located within casino cage 120, although it may be located on the floor of casino 100 under the supervision of casino personnel.

Figure 5C:
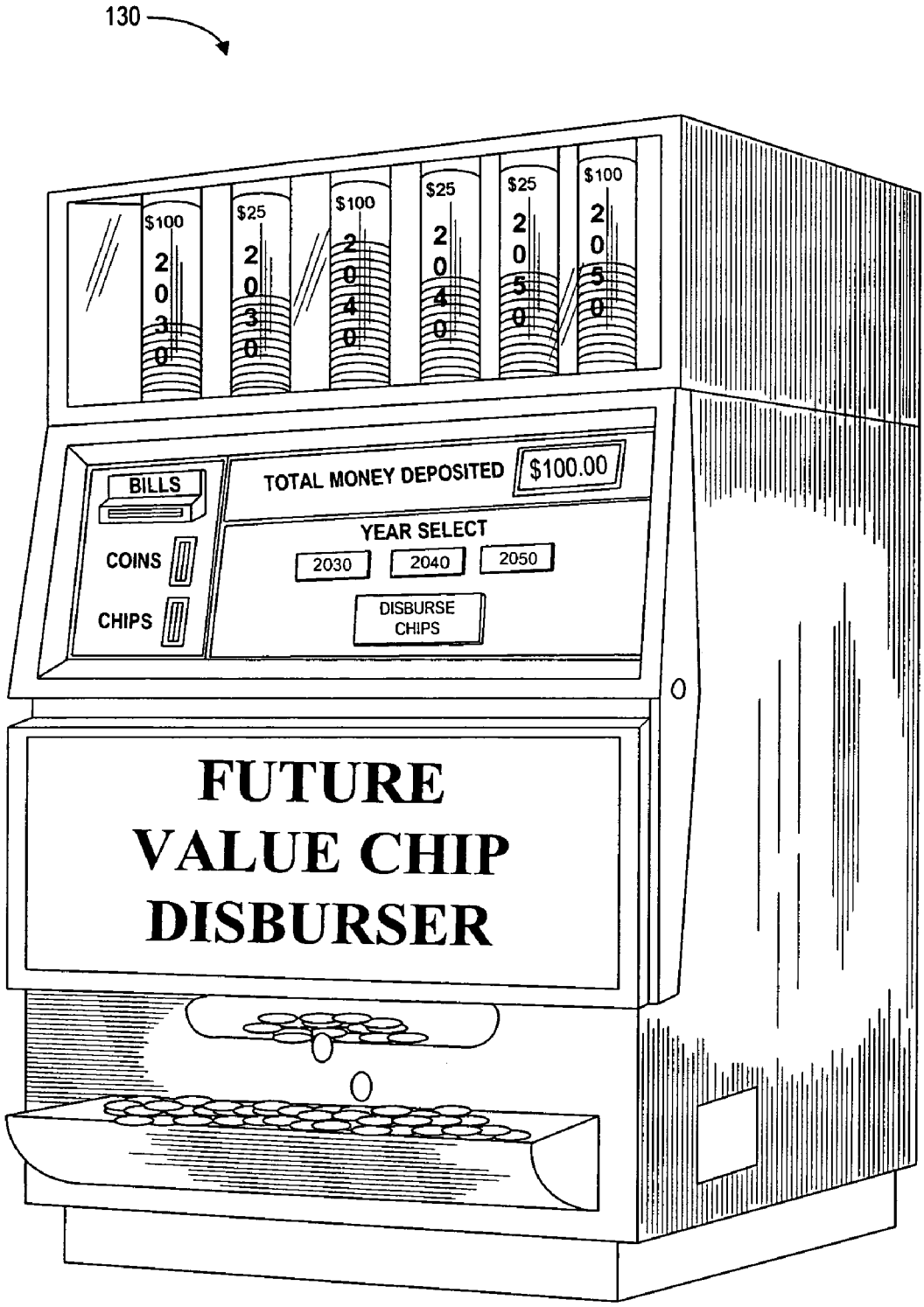
FIG. 5*c* shows a plan view of an alternative embodiment of the disburser of FIG. 2.

The methods and systems of the present invention may be automated so as to eliminate the requirement for casino personnel in future value chip transactions. With reference to FIG. 5*c*, there is shown a plan view of a physical embodiment of disburser 130 having the functionality described with respect to FIG. 5*a* above. Specifically, disburser 130 has several input devices which allow the customer to insert bills and tokens. "Year Select" buttons allow the player to select the maturity date of the future value chips disbursal. After depositing a current value of chips and/or currency, a player selects a maturity and presses "Disburse Chips" button to initiate the disbursement of future value chips into the payout tray. In yet another embodiment, disburser 130 may be readily configured to accept future value tokens for conversion into present value currency.

Figure 6:
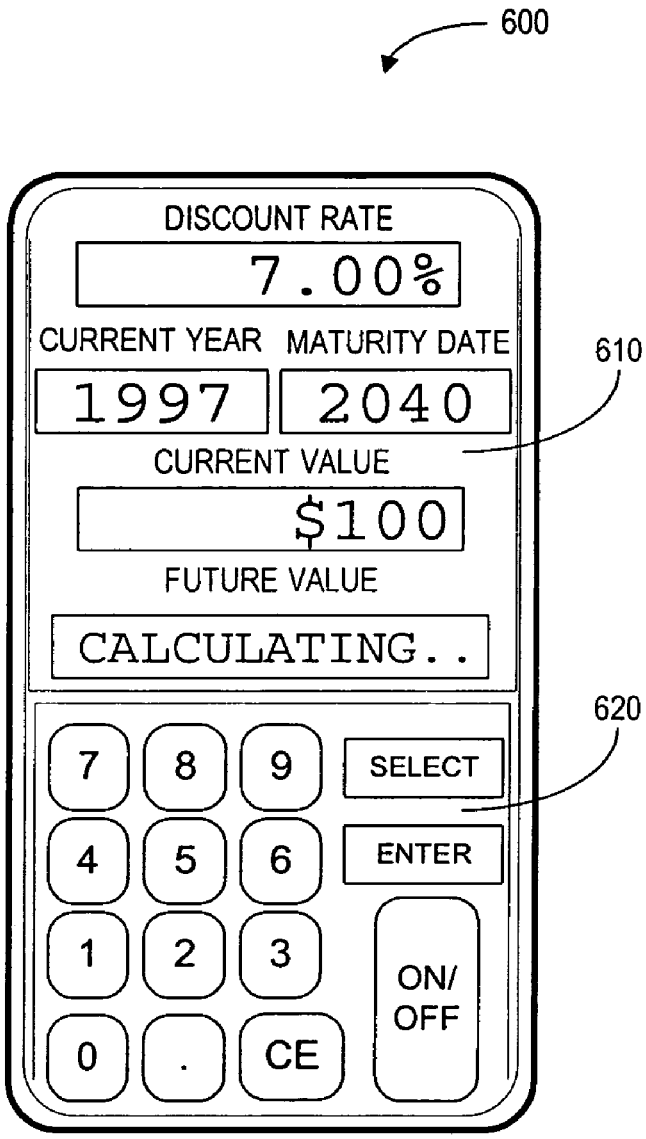
FIG. 6 shows a front view of a conversion calculator.

With reference to FIG. 6, there is shown a future value calculator 600 which is constructed to enable the convenient performance of future value calculations. In operation, the user enters four of the five variables (i.e. discount rate, current year, maturity date, present value, and future value) as shown in display area 610. This display area can consist of LCD or LED displays, such as commonly found in conventional calculators. The variables are entered using the buttons of keypad 620. After pressing the enter button for the entry of the fourth variable, calculator 600 determines the fifth variable and displays it in the appropriate window of display area 610. The example shown in FIG. 6 illustrates calculator 600 processing a future value based on the variables entered. After the calculation is complete, the result is displayed to the user in the "Future Value" display area. Calculator 600 incorporates a conventional financial calculator processor or circuit well known to those skilled in the art, and may include an optional printer attachment to allow the calculations to be printed.

Figure 7:
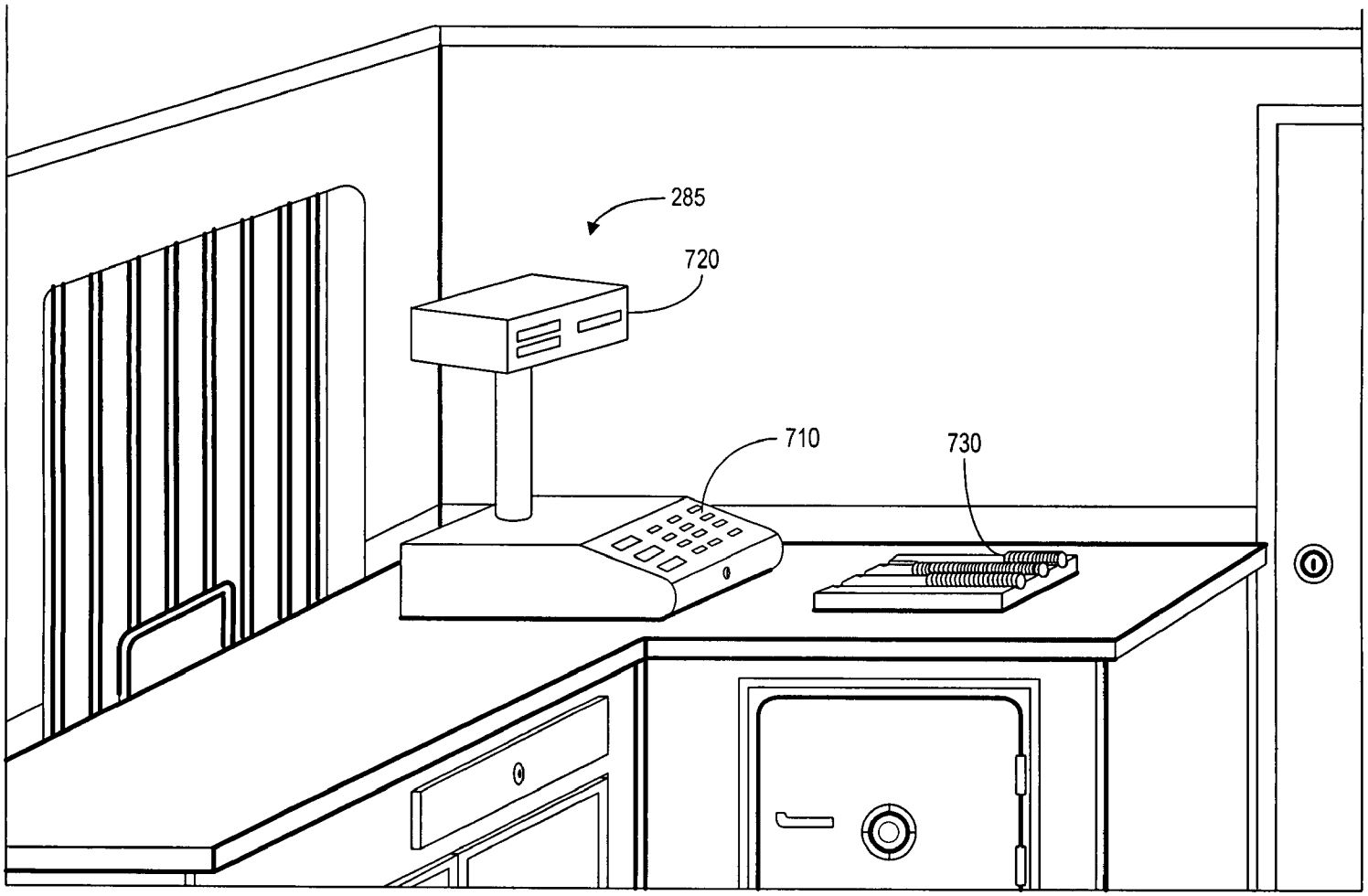
FIG. 7 shows an illustrative view of the casino cage of FIG. 1.

FIG. 7 shows yet another embodiment of the present invention for use within casino cage 120. In this embodiment, I/O device 285 is shown to include a keypad 710 and display 720. A cashier enters the amount of present value chips and the desired maturity date into I/O device 285, shown here having a keypad 710 for input and display 720 output. A processor within keypad 710 retrieves the appropriate discount rate from a memory and calculates the amount of future value chips to be disbursed. The result is subsequently shown in display area 720. Display area 720 is preferably rotatable so that it may be turned toward either the cashier or the customer. The cashier reads the display and selects the chips to payout from a chip inventory 730. Alternatively, the payout may be in currency from a cash drawer (not shown). It will be understood that the embodiment of FIG. 7 includes a conventional keypad 710, display 720, and financial calculation processor (not shown)

Figure 9:
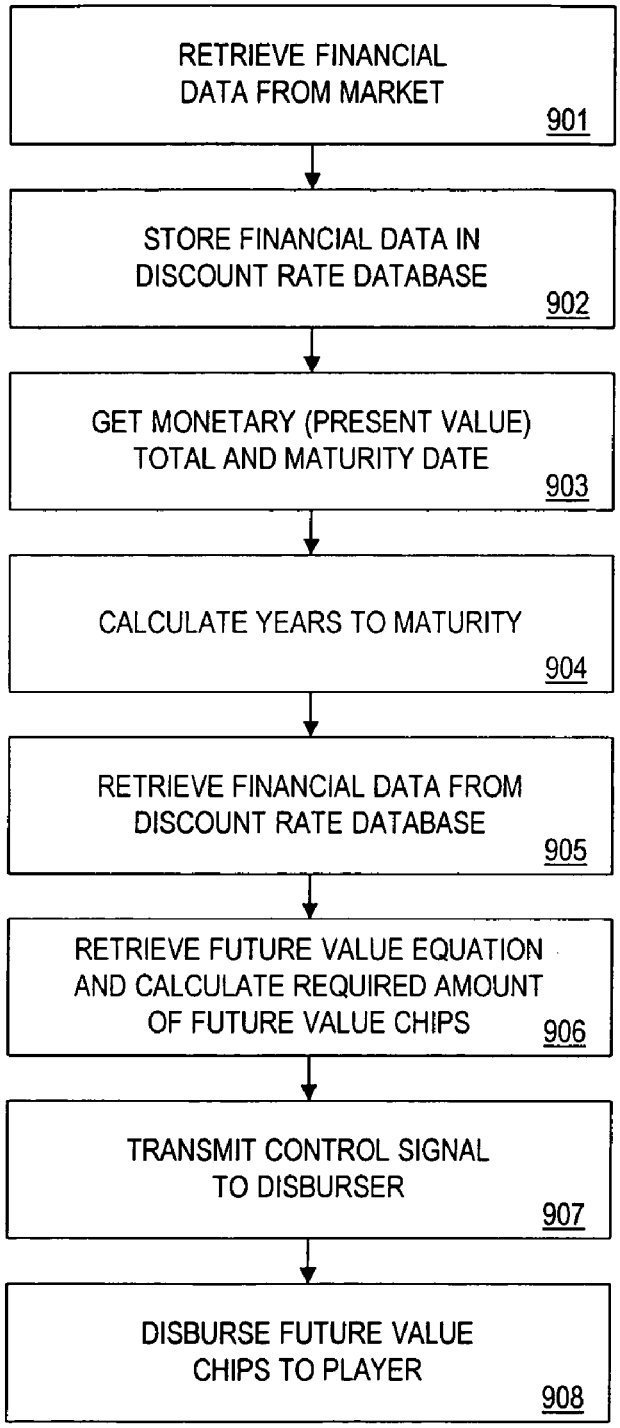
FIG. 9 is a flow chart describing an exemplary chip conversion process as implemented by the central controller of FIG. 1.

Referring now to FIG. 9, there is shown a flow chart of steps in practicing a chip conversion process in accordance with one aspect of the invention. In particular, in step S901 CPU 240 retrieves discount rate data from financial market 160. This discount rate data typically includes the prevailing interest rates for various maturity dates, as an example, for treasury bonds. This discount rate data is then stored by CPU 240 in step S902 in discount rate database 260. Typically, the casino updates this data at least on a daily basis, although it may do so more or less often.

In step S903 CPU 240 receives as an input from I/O device 285 the amount of present value money to be exchanged for future value chips, as well as the maturity date of the future value chips, as input by the casino cashier. The maturity date desirably corresponds to one or more pre-established maturity dates. For example, a casino may offer the customer the choice of chips with a maturity date of the year 2030, 2040, or 2050 (hereinafter referred to as "2030 chips," "2040 chips," and "2050 chips"). Restricting the number of maturity dates available greatly reduces inventory requirements for the casino, and is a simpler system for casino game personnel to administer. One embodiment of I/O device 285 includes the money amount and maturity date being entered, for example, via a keyboard. Another embodiment of I/O device 285 includes the monetary amount being entered via a player or cashier inserting money into an automated money machine while the maturity date is entered via a keyboard. Yet another embodiment of I/O device 285 includes a device having different pre-defined slots to receive currency, where each slot corresponds to a different maturity date. The I/O device automatically determines the amount of money a player or cashier inserts into each slot, and automatically determines the maturity date by virtue of which slot the money is inserted into.

Next, CPU 240 calculates the years to maturity of the future value chip at step S904. A "2030 chip" purchased in 1997 has a time to maturity of 33 years (i.e. 2030-1997). If additional precision is required, time to maturity may be calculated in months, weeks, or even days.

In step S905 CPU 240 retrieves the discount rate data from discount rate database 260 which corresponds to the desired maturity date input in step S903. Because the interest rates stored in discount rate database 260 may cover maturity dates different from the maturity date of the requested future value chip, CPU 240 may adjust the interest rate for the closest maturity date using interpolation methods. For example, if the customer requests "2030 chips" as described above, and the time to maturity of these future value chip is 33 years, CPU 240 may simply use the interest rate with the closest maturity date. Field 304 of discount rate database 260, for example, shows the treasury yield for a maturity date of February 2027. In this case, the 6.91% rate from record 312 is used. Alternatively, a more accurate interest rate may be calculated by taking the 0.09% difference between the twenty year and thirty year rates (i.e. 7.00% less 6.91%), dividing it by ten, and then multiplying by three to obtain the interest rate adjustment for the additional three years (0.09%/10×3=0.027%). Thus, CPU 240 would output a rate of 6.91%+0.027%=6.937%.

In step S906 CPU 240 retrieves the future value equation from ROM 220 and calculates the future value of the present value input in step S903, using the years to maturity calculated in step S904, and the discount rate data retrieved or calculated in step S905. CPU 240 then determines the number and denomination of future value chips to be disbursed based upon the calculated future value dollar amount. For example, a player with $100 in current value chips (1997) may ask to exchange them for future value chips which mature in the year 2030. The future value chips to be disbursed to the player are calculated thusly:

$$FV=PV*(1+r)^n$$

$$FV=100*(1+0.06937)^{33}$$

$$FV=100*(9.1458)$$

$$FV=\$914.58$$

The player could thus place bets of more than nine hundred and fifty dollars in future value chips, more than nine times what he could bet with his current value chips.

In step S907 CPU 240 sends to the chip disburser 132 a control signal indicating the amount of future value chips to be disbursed. In the illustrative example, $914.58.

In step S908 the future value chips disburser 132 subsequently disburses the amount of future value chips to the player or cashier based upon the control signal received from CPU 240. In order to simplify the implementation of the present system, casinos may restrict future value chips to a limited number of denominations. Consequently, one dollar or even five dollar tokens may constitute the lowest denomination. In the case where future value chips are requested for less than the minimum denomination, the casino may wish to disburse current value chips, or elect to round down the amount of future value chips disbursed.

In another embodiment, the calculation of future value at step S906 is performed by chip disburser 130, rather than CPU 240. In this embodiment, CPU 240 transmits the years to maturity, present value total, and appropriate discount rate to disburser 130, which then proceeds to calculate the amount of future value chips to disburse using the future value equation as discussed above.

In a further embodiment, the methods and systems of the present invention are incorporated into a conventional slot machine, allowing players to wager and receive payment with future value chips. The player selects a wager by depositing coins or chips or by pressing a button to wager stored credits. The slot machine stores the value of the wager as an electronic credit balance. Before each handle pull, the player is given the option of selecting from among various payout tables, with each payout table representing payouts expressed in varying maturities of current or future value. For example, while the conventional current value payout for three cherries may be fifteen coins, the corresponding payout in "2030 chips" may be one hundred coins. As the player accumulates coins of varying maturity dates, the slot machine stores each chip maturity as a separate credit balance. Future value chips of different maturities may of course be converted from one maturity to another, or disbursed at the end of play. If the slot machine is configured with a printer and access to bond database 260, it may print bond certificates instead of disbursing future value chips. One advantage to a slot machine capable of printing bond certificates is that the machine would not have to keep an inventory of future value chips. All payouts could be accomplished with bond certificates.

Rather than specifying the maturity date of the future value chips, some gamblers may want to provide the casino with a desired present value and future value. A player with one hundred dollars who wanted five hundred in future value chips, for example, might receive future value chips with a maturity date at least 24 years in the future as shown below:

$$FV=PV*(1+r)^n$$

$$500=100*(1.07)^n$$

$$5=(1.07)^n$$

$$\log 5/\log 1.07=n$$

$$n=23.7876$$

It should be noted that in the above example since the maturity date is not known in advance, the appropriate discount rate should be selected based on at least a rough approximation of the maturity date. In this example, the casino could simply select an appropriately conservative discount rate.

In another embodiment, the player asks for a given amount of future value chips of a given maturity, and is provided with the present value "cost" of these chips. It is important to note, however, that in calculating the present value a more conservative result (i.e. a higher cost to the gambler) is obtained by using higher discount rates, thus the casino may use a discount rate in excess of their weighted average cost of capital. Much like a bank which charges a different exchange rate depending on whether a customer is buying or selling a foreign currency, the casino may use a different discount rate depending on whether the customer is buying or selling future value chips.

Once the player is in possession of the future value chips he proceeds to a gaming table such as blackjack table 111. Each winning wager is preferably paid with an appropriate amount of future value chips of the same maturity. It is important that the dealer carefully distinguish between future and current value chips as the latter are far more valuable. For this reason, future value chips may be of a different color, size, or shape than current value chips. Future value chips may also be kept in a separate area of the dealer's chip tray, or a separate table area away from current value chip tables where only future value chips are used.

Although dealers typically do not have the responsibility of exchanging current value chips for future value chips, it will be appreciated that the availability of a hand held device such as calculator 600 shown in FIG. 6 may allow the dealer to make such transactions on an occasional basis.

Figure 10:
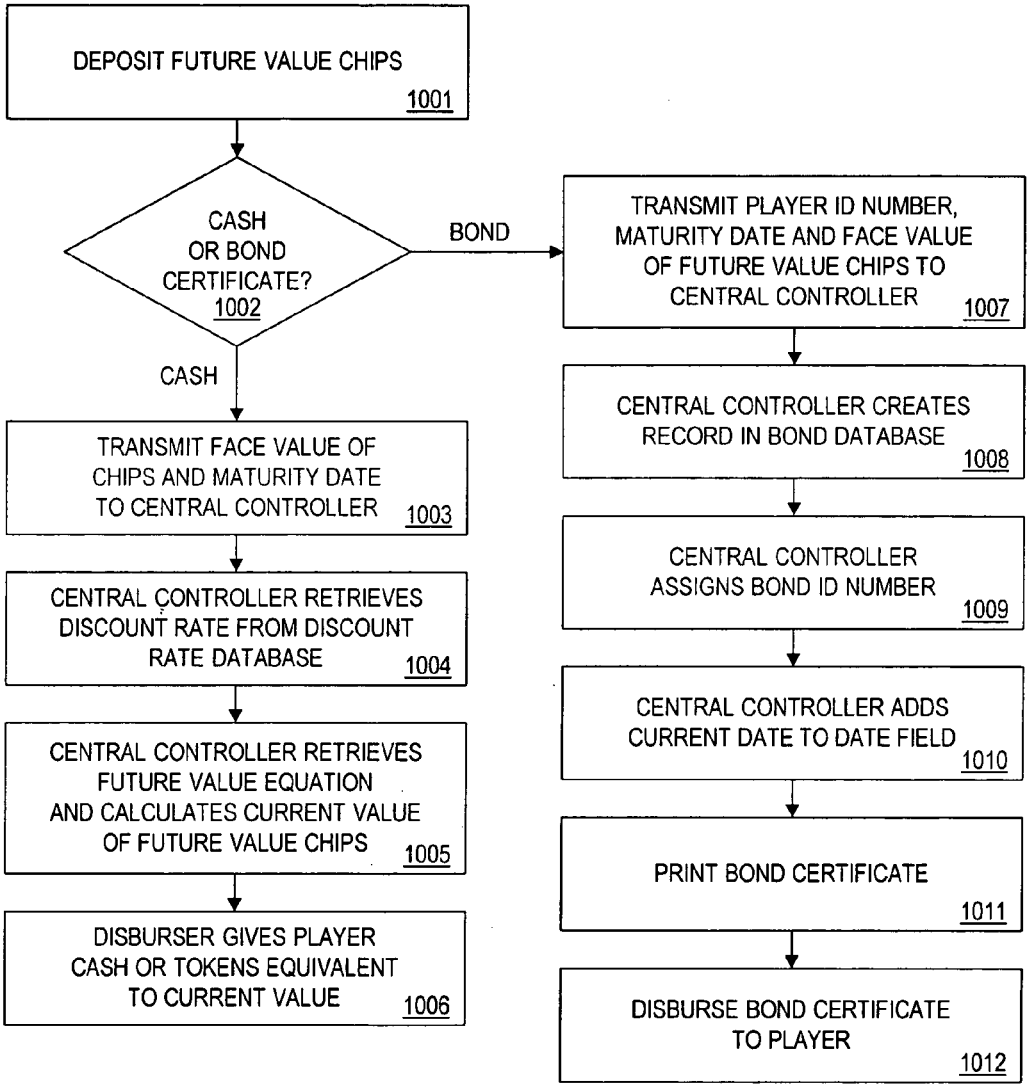
FIG. 10 is a flow chart describing an exemplary chip cash out process as implemented by the central controller of FIG. 1.

At various times during or after play, a player may choose to cash in or exchange his future value chips. FIG. 10 illustrates a process for cashing in future value chips in accordance with another aspect of the invention.

In step S1001 the player provides his future value chips to the cashier and selects in step S1002 whether he would like to have cash or a bond certificate. In an alternate embodiment, the player deposits his future value chips into disburser 130.

If the player chooses to cash in his future value chips for current value chips, then the monetary face value and maturity dates of the future value chips are transmitted to the central controller at step S1003. At step S1004, the CPU 240 retrieves the appropriate discount rate from discount rate database 260. Flow then proceeds to step S1005 where CPU 240 retrieves the future value equation from ROM 220 and calculates the current value of the future value chips. In step S1005, CPU 24C sends a control signal to I/O device 285 indicating approval to dispense in cash the present value calculated in step S1005. Alternatively, CPU 240 transmits a signal to a cashier who dispenses the cash manually.

If the player in step S1002 elects to exchange his future value chips for a bond certificate, then CPU 240 proceeds to step S1007 and receives as an input the player's ID number and face value of the future value chips deposited in step S1001. CPU 240 then proceeds to step S1008 where it creates a new record in bond database 270. This record is indexed by player ID number, allowing CPU 240 to quickly determine the status of a particular bond at the request of a customer.

At step S1009, CPU 240 assigns a bond ID number to the newly created record. At step S1010, the current date is retrieved from clock 230 and entered into the date issued field 403 of bond database 270. CPU 240 then transmits the bond ID number 401, customer ID number 402, customer name 403, date issued 404, maturity date 405, and face value 406 to printer 295. At step S1011, printer 295 generates the bond certificate 1100 as illustrated below with reference to FIG. 11. CPU 240 then proceeds to step S1012 where CPU 240 controls printer 295 to print the bond certificate with CPU 240 sending a control signal to the printer to disburse the certificate to the player, or alternatively, the cashier gives the bond certificate to the player.

Figure 11:
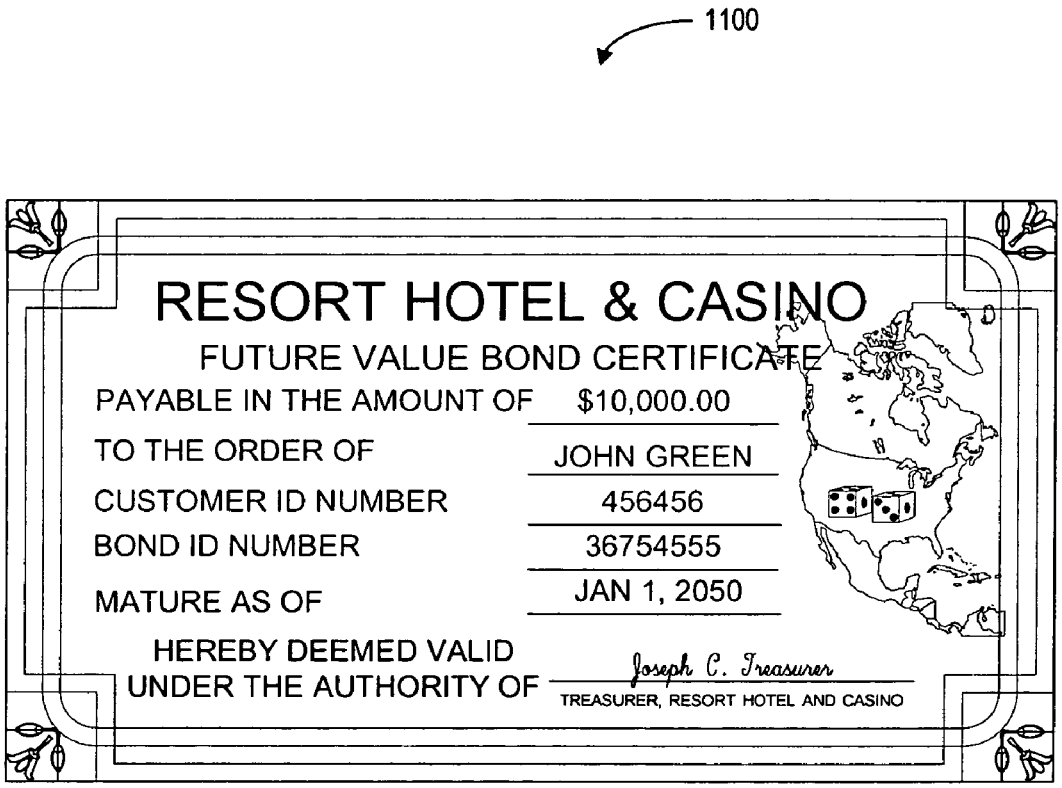
FIG. 11 shows an illustrative view of a future value bond certificate as produced by the printer of FIG. 2.

FIG. 11 shows an illustrative bond certificate 1100. Because the bond certificate is tied to a record in bond database 270, the only critical element to display is the bond ID number, from which all other information may be derived. The other information is primarily displayed for the convenience of the player. The information displayed corresponds to the content of record 410 of bond database 270.

Alternatively the player may choose to retain the future value chips until the maturity date is reached, and at that time return the future value chips to the casino to redeem them for their face value. One benefit is that a player may use the future value chips as a convenient form of "savings bond" which might be given to children or grandchildren with the intention of funding future educational needs.

The player may also elect to hold the future value chips for a number of years, and then redeem them before the maturity date is reached. For example, a player holding "2030 chips" may choose to redeem them at any time after they were obtained but prior to the maturity date. The value of those future value chips will be determined as above by application of the future value equation using the updated discount rate and years to maturity.

Because maturity dates are in some cases thirty or more years into the future, some players may be apprehensive as to the financial solvency of the issuing casino. This can be resolved similarly to what is presently done when a casino is closing down. The casino advertises that they are closing and thereby give customers holding chips a time span in which they may redeem the value of their chips. In the case of future value chips, the casino uses the future value equation described above to determine the amount of money to pay customers holding such chips.

Figure 8:
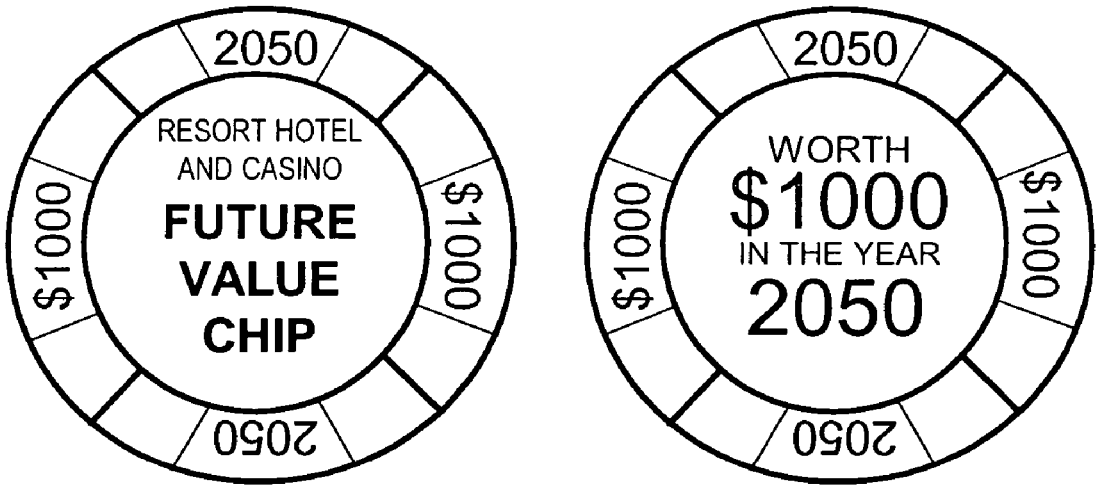
FIG. 8 shows both a front and rear view of an illustrative future value chip.

Referring now to FIG. 8, there is shown a front and rear view of an illustrative future value chip. The future value chip looks much like a conventional casino chip in that it lists the name of the casino and the denomination of the chip, although it differs in that it also contains the maturity date of the chip. Although described as a chip, it could also take the form of any appropriate token. Any substrate sufficient to support the printing of a maturity date and face value could function as a future value chip. Conventional anti-counterfeiting strategies could of course be adopted to secure a future value chip, especially to ensure that the maturity date is not altered in an attempt to cash in the chip at an earlier date. A future value chip might even be embodied in paper form, although such an embodiment would require more significant anti-counterfeit measures. Each future value "paper chip" could have a unique identification number imprinted on it, with the number being stored and subsequently checked in a database of central controller 140 before cashing. In such an embodiment, each "paper chip" operates similarly to the bond certificates previously described.

The casino can designate certain classes of chips that have various restrictions attached. While future value chips may normally be converted into present value chips at any time, the casino could issue future value chips which can be redeemed only at maturity. As is evident to one skilled in the art, the ability to create different classes of future value chips with different restrictions allows the casino to retain greater control over how the player redeems the chips.

Described now for illustrative purposes only, are examples of a player and casino practicing various aspects of the invention.

In a first example, a player entering a casino proceeds to the casino cage 120 and requests that the cashier converts $100 into "2030 chips." The cashier enters that data with central controller 140 via I/O device 285. CPU 240 then retrieves the appropriate discount rate from discount rate database 260, and calculates the years to maturity. For purposes of this example, it is assumed that a discount rate of 6.91% is used, as shown in record 312. CPU 240 then calculates the future value based on input variables as follows:

$$FV=PV*(1+r)^n$$

$$FV=100*(1+0.0691)^{33}$$

$$FV=100*(9.06995)$$

$$FV=\$906.99$$

This information is conveyed to the cashier via I/O device 285. The cashier then gives the player nine $100"2030 chips," six $1"2030 chips," and change. The change is likely to be retained by the casino, or provided to the player in current value, avoiding the need for small denomination future value coinage.

The player can now proceed to the gambling tables and place bets of up to $906, which is nine times greater than what he would have been able to bet using conventional chips. For each winning wager, the player receives a payout in the appropriate maturity of future value chips. In some instances, at the discretion of the casino, a player may be able to obtain chips having different maturity dates. For instance, if a payoff for a $100 future value chip bet is $300 in future value chips having the same maturity date, he may be offered the option of taking $350 in longer term future value chips. Conversely, the player may be offered the option of taking $250 in shorter term future value chips.

When the player has finished gambling, he takes his future value chips back to the casino cage 120 to cash them in. At the cage the player hands the future value chips to a cashier and specifies either cash (if allowed by the particular class of chips) or a bond. This can be done through a live cashier, or by depositing his future value chips into disburser 132. The cashier enters the monetary face value of the future value chips and their maturity dates via I/O device 285. CPU 240 takes the face value of the future value chips and the maturity data, retrieves the appropriate discount rate and calculates the present value of the chips. Assuming that the player gave the cashier $400 in "2030 chips," CPU 240 then displays to the cashier the present value of those chips, which, using the data described above would be about $44. The cashier then gives the money to the player.

If the player instead chooses a bond, the cashier enters the name of the player, the future value amount and the maturity dates using I/O device 285. CPU 240 takes this information, creates a record in bond database 270 and enters this information into the record, assigning a unique bond ID number. CPU 240 then directs the printing of the bond certificate, and the cashier hands the certificate to the player.

In another example, the player acquires future value chips for a gambling session using an automated future value chip disburser such as disburser 130. Here the player approaches an automated future value chip disburser 130. The player then inserts his currency into a currency acceptor. The currency sensing device 516 then determines the amount of funds deposited. For example, the player inserts $200 in twenty dollar bills and selects "2040 chips." Alternatively, there may be a separate currency acceptor for each maturity date available. This information is transmitted to CPU 240, which retrieves the appropriate discount rate from discount rate database 260, for example the 6.91% from record 312, and calculates the future value of $3,538.49. CPU 240 then transmits a signal to future value chip disburser 132 to disburse the appropriate number of "2040 chips." As in the previous example, the player takes those chips and places bets with them.

Once the player has finished playing, he can then return, for instance, to the future value chip disburser 130, or to a cashier, to cash in his future value chips. If he opts for the chip disburser 130, he deposits his future value chips into the chip acceptor and selects either cash or bond using input 512. Chip sensing device 519 determines both the denomination and maturity date of each chip deposited. If he selected cash, the future value chip disburser 130 calculates the present value of the future value chips. CPU 240 takes the above data, retrieves the appropriate discount rate from discount rate database 260 and calculates the present value of those future value chips. CPU 240 then instructs the future value chip disburser 130 to disburse the appropriate amount of cash to the player. Alternatively, if the player selects to cash in his chips for a bond, then the player enters in his name via input device 512, and the chip disburser 130 retrieves the face value and maturity date of the future value chips. CPU 240 then creates a new record in bond database 270 and stores the entered information into the database. CPU 240 then instructs printer 295 to print a bond certificate and provide that bond certificate to the player.

When the bond matures, the player takes the bond to the casino for redemption. Depending on the initial restrictions placed on the class of future value chips used, the redemption may be in cash, payment to an account, or by other means.

In the manner described above, the present invention thus provides a system and method for future value wagering. While this invention has been described with reference to the preferred embodiments, other modifications will become apparent to those skilled in the art by study of the specification and drawings. It is thus intended that the following appended claims include such modifications as fall within the spirit and scope of the present invention.

What is claimed is:

1. A gaming device comprising:

a processor;

an input device;

a display device; and a storage device which stores a plurality of instructions, which when executed by said processor, cause said processor to operate with said input device and said display device to:

(a) prior to a maturity date associated with a gaming token issued by a casino at a first point in time, enable a player to deposit the gaming token, wherein the gaming token is associated with a maturity value;

(b) cause a determination of a credit balance of a first amount of wagering credits, wherein said determined credit balance of the first amount of wagering credits is based on the deposited gaming token, and the first amount of wagering credits is less than an amount of wagering credits associated with the maturity value;

(c) display the credit balance of the first amount of wagering credits;

(d) enable the player to wager at least part of said first amount of wagering credits to play a wagering game at the casino at a second, subsequent point in time; and (e) deduct any amount of wagering credits wagered on the play of the wagering game from the first amount of wagering credits.

2. The gaming device of claim 1, wherein said storage device further stores at least one of: (i) a discount rate database, and (ii) a future value database.

3. The gaming device of claim 1, wherein the first amount of wagering credits is based on the maturity value, the present date and the maturity date.

4. The gaming device of claim 3, wherein the first amount of wagering credits is further based on discount rate information.

5. The gaming device of claim 1, wherein the gaming token displays indicia of both the maturity value and the maturity date.

6. A method of operating a gaming system, said method comprising:

(a) prior to a maturity date associated with a gaming token issued by a casino at a first point in time, enabling a player to deposit the gaming token, wherein the gaming token is associated with a maturity value;

(b) causing a determination of a credit balance of a first amount of wagering credits, wherein said determined credit balance of the first amount of wagering credits is based on the deposited gaming token, and the first amount of wagering credits is less than an amount of wagering credits associated with the maturity value;

(c) causing the credit balance to display the first amount of wagering credits;

(d) enabling the player to wager at least part of said first amount of wagering credits to play a wagering game at the casino at a second, subsequent point in time; and (e) deducting any amount of wagering credits wagered on the play of the wagering game from the first amount of wagering credits.

7. The method of claim 6, wherein the first amount of wagering credits is based on the maturity value, a present date and the maturity date.

8. The method of claim 7, wherein the first amount of wagering credits is further based on discount rate information.

9. The method of claim 6, wherein the gaming token displays indicia of both the maturity value and the maturity date.

10. A gaming device comprising:

a processor;

an input device;

a display device; and a storage device which stores a plurality of instructions, which when executed by said processor, cause said processor to operate with said input device and said display device to:

(a) receive a gaming token associated with a maturity value and a maturity date, said gaming token being previoulsy issued by a casino;

(b) determine if a present date is prior to the maturity date;

(c) if the present date is prior to the maturity date:

(i) cause a determination of, a first credit balance of a first amount of wagering credits, wherein the determined first credit balance of the first amount of wagering credits is based on the received gaming token and the first amount of wagering credits is less than an amount of wagering credits associated with the maturity value, (ii) display the first credit balance of the first amount of wagering credits (iii) enable a player to place one of a plurality of different wagering credit amounts to play a wagering game at the casino, and (iv) deduct any amount of wagering credits placed on the play of the wagering game from the first amount of wagering credits; and (d) if the present date is not prior to the maturity date:

(i) cause a determination of a second credit balance of a second, different amount of wagerinq credits, wherein said determined second credit balance of the second amount of wagering credits is based on the received gaming token and said second amount of wagering credits is the amount of wagerinq credits associated with the maturity value, (ii) display the second credit balance of the second amount of wagering credits, (iii) enable the player to place one of the plurality of different wagering credit amounts to play the wagering game at the casino, and (iv) deduct any amount of wagering credits placed on the play of the wagering game from the second amount of wagering credits.

11. A method of operating a gaming system, said method comprising:

(a) receiving a gaming token associated with a maturity value and a maturity date, said gaming token being previoulsy issued by a casino;

(b) determining if a present date is prior to the maturity date;

(c) if the present date is prior to the maturity date:

(i) causing a determination of a credit balance of a first amount of wagering credits, wherein said determined credit balance of the first amount of wagering credits is based on the received gaming token and the first amount of wagering credits is less than an amount of wagering credits associated with the maturity value, (ii) causing the credit balance to display the first amount of wagering credits, (iii) enabling a player to place one of a plurality of different wagering credit amounts to play a wagering game at the casino, and (iv) deducting any amount of wagering credits placed on the play of the wagering game from the first amount of wagering credits; and (d) if the present date is not prior to the maturity date:

(i) causing a determination of the credit balance to display a second, different amount of wagering credits, wherein said determined credit balance of the second amount of wagering credits is based on the received gaming token and said second amount of wagering credits is the amount of wagering credits associated with the maturity value, (ii) causing the credit balance to display the second amount of wagering credits, (iii) enabling the player to place one of the plurality of different wagering credit amounts to play the wagering game at the casino, and (iv) deducting any amount of wagering credits placed on the play of the wagering game from the second amount of wagering credits.

12. A gaming device, comprising:

a processor;

an input device;

a display device; and a storage device which stores a plurality of instructions, which when executed by said processor, cause said processor to operate with said input device and said display device to:

(a) at a first point in time, enable a player to place a wager to play a wagering game at a casino; and (b) for the play of the wagering game:

(i) determine to provide any of a plurality of different awards to the player, (ii) if the determination is to provide any of the plurality of different awards, enable the player to select whether to be provided:

(A) a gaming token associated with a future value on a maturity date, said gaming token being redeemable for at least one subsequent play of the wagering game at the casino at a second, subsequent point in time, or (B) an amount of currency equivalent to a present value of the gaming token, and (iii) provide the player the selected one of:

(A) the gaming token, or (B) the amount of currency.

13. A method of operating a gaming system, said method comprising:

(a) at a first point in time, enabling a player to place a wager to play a wagering game; and (b) for the play of the wagering game:

(i) determining to provide any of a plurality of different awards to the player, (ii) if the determination is to provide any of the plurality of different awards, enabling the player to select whether to be provided:

(A) a gaming token associated with a future value on a maturity date, said gaming token being redeemable for at least one subsequent play of the wagering game at the casino at a second, subsequent point in time, or (B) an amount of currency equivalent to a present value of the gaming token, and (iii) providing the player the selected one of:

(A) the gaming token, or (B) the amount of currency.

* * * * *

UNITED STATES PATENT AND TRADEMARK OFFICE

CERTIFICATE OF CORRECTION

PATENT NO. : 8,137,187 B2
APPLICATION NO. : 11/435118
DATED : March 20, 2012
INVENTOR(S) : Jay S. Walker et al.

It is certified that error appears in the above-identified patent and that said Letters Patent is hereby corrected as shown below:

IN THE CLAIMS

In Claim 3, Column 13, Line 46, replace the second instance of "the" with --a--.
In Claim 6, Column 13, Line 66, replace "the credit balance" with --a display device--, and between "display" and "the" insert --the credit balance of--.
In Claim 10, Column 14, Line 25, replace "previoulsy" with --previously--.
In Claim 10, Column 14, Line 29, delete the "," after "of".
In Claim 10, Column 14, Line 39, replace "to" with --on a--, and between "play" and "a" insert --of--.
In Claim 10, Column 14, Lines 46 and 50, replace "wagerinq" with --wagering--.
In Claim 10, Column 14, Line 55, replace "to" with --on a-- and after "play" insert --of--.
In Claim 11, Column 14, Lines 63 to 64, replace "previoulsy" with --previously--.
In Claim 11, Column 15, Line 7, replace "the credit balance" with --a display device--, and between "display" and "the" insert --the credit balance of--.
In Claim 11, Column 15, Line 10, replace "to" with --on a--, and between "play" and "a" insert --of--.
In Claim 11, Column 15, Line 16, replace "the" with --a--.
In Claim 11, Column 15, Lines 16 to 17, replace "to display" with --of--.
In Claim 11, Column 15, Line 24, replace "credit balance" with --display device--, and between "display" and "the" insert --the credit balance of--.

Signed and Sealed this
Twenty-third Day of April, 2013

Teresa Stanek Rea
*Acting Director of the United States Patent and Trademark Office*